US005199219A

United States Patent [19]

Martini et al.

[11] Patent Number: 5,199,219

[45] Date of Patent: Apr. 6, 1993

[54] WINDOW JAMB LINER

[75] Inventors: James A. Martini; Norman R. Westfall; Richard S. deNormand, all of Rochester, N.Y.

[73] Assignee: Caldwell Manufacturing Company, Rochester, N.Y.

[21] Appl. No.: 734,202

[22] Filed: Jul. 22, 1991

[51] Int. Cl.[5] ..... E05D 15/16

[52] U.S. Cl. ..... 49/428; 49/459; 49/414

[58] Field of Search ..... 49/423, 424, 428, 459, 49/419, 414, 429, 430, 434, 422, 181

[56] References Cited

U.S. PATENT DOCUMENTS

| | | | |
|---|---|---|---|
| 2,600,786 | 6/1952 | Lockwood . | |
| 2,877,514 | 3/1959 | Mears, Jr. . | |
| 2,879,559 | 3/1959 | Lundgren . | |
| 3,058,176 | 10/1962 | Zegers . | |
| 3,122,798 | 3/1964 | Zegers et al. | 49/430 |
| 3,145,433 | 8/1964 | Jones . | |
| 3,197,819 | 8/1965 | Trout | 49/423 |
| 3,206,804 | 9/1965 | Perry | 49/422 X |
| 3,399,490 | 9/1968 | Hettinger | 49/414 |
| 3,724,131 | 4/1973 | Schnörmeier . | |
| 4,034,510 | 7/1977 | Huelsekopf | 49/419 |
| 4,096,665 | 6/1978 | Ellingson | 49/414 X |
| 4,570,382 | 2/1986 | Suess . | |
| 4,726,148 | 2/1988 | Tix | 49/453 |
| 4,916,863 | 4/1990 | Burrous et al. . | |

OTHER PUBLICATIONS

Photocopy of Cross-Sectional View of Three Jamb Liners.

*Primary Examiner*—Renee S. Luebke
*Assistant Examiner*—Jerry Redman
*Attorney, Agent, or Firm*—Eugene Stephens & Associates

[57] ABSTRACT

A jamb liner for a window assembly permits tilt-takeout sashes to be assembled to form a standard window assembly without tilt or takeout capabilities. The liner has an extruded body with a pair of channels for engaging the sashes. The channels are interconnected by two webs. One of the webs forms adjacent portions of sash runs, and the other web forms a bow-shaped spring for urging the channels against the sashes.

14 Claims, 3 Drawing Sheets

WINDOW JAMB LINER

BACKGROUND OF INVENTION

Standard window assemblies with double sash runs are made with sashes that cannot be removed from the sash runs without disassembling the window. However, so-called tilt-takeout window assemblies that permit sash removal are also in widespread use.

Generally, both the window sashes and jamb liners forming the sash runs are designed much differently for use with either standard or tilt-takeout window assemblies. Since both types of assemblies are widely used, window manufacturers are required to stock inventories of the different sashes and jamb liners. Of the two, the sashes are much more costly to stock in inventory than the jamb liners.

Accordingly, a number of attempts have been made to make both standard and tilt-takeout sashes compatible with one or the other window assembly types. For example, U.S. Pat. No. 3,724,131 to Schnormeier discloses special jamb liners for adapting standard window sashes to tilt-takeout window assemblies. However, Schnormeier's attempt requires costly slots be formed along jambs to receive the special liners.

Other jamb liners have been designed to adapt tilt-takeout sashes to standard window assemblies. These other liners have also not been very successful because they have not provided appropriate tracking for the tilt-takeout sashes. The liners are not well reinforced, and pairs of springs built into the liners for urging the liners against the sashes tend to warp the liners away from jambs along portions of sash runs not currently occupied by the sashes. Ordinarily, only one or the other of the springs is compressed by one of the sashes along most of the jamb liner length. The other spring is free to urge an adjacent portion of the liner away from the jamb.

SUMMARY OF INVENTION

Our invention is an improved jamb liner for mounting tilt-takeout window sashes between jambs to form standard window assemblies. The improved jamb liner is made with a single spring that reduces tendencies of the sashes to warp the liner, and the liner is configured to exhibit increased torsional rigidity to resist any residual warping that might otherwise occur. Together, the single spring and rigid configuration provide better tracking for the sashes.

The liner can be made as an extruded body having two pairs of tracks for engaging respective sash plows of upper and lower sashes. The tracks of both pairs are joined by respective channels that can be used to house sash balances. The channels are joined by two webs. One of the webs forms separate portions of sash runs for the respective upper and lower sashes, and the other web forms a spring for urging the channels away from a jamb against the respective sashes.

The spring is bow-shaped between two ends; and respective brackets, also formed in the other web, connect the two spring ends to the respective channels. The single bow-shaped spring is used to urge both channels against their respective sashes. Accordingly, to the extent the spring is compressed along a portion of its length through either channel by one of the sashes, less spring travel remains to urge the other channel away from the jamb along a corresponding portion of the spring length. The brackets connecting the spring to the channels also function as stops for limiting compression of the spring.

The channels are also connected to marginal flanges by respective pairs of webs. One of the webs of each of these pairs of webs forms a remaining portion of each of the sash runs. The other of the webs connecting the marginal flanges to respective channels reinforces the connection and contributes to overall torsional rigidity of the liner.

DRAWINGS

DETAILED DESCRIPTION

Figure 1:
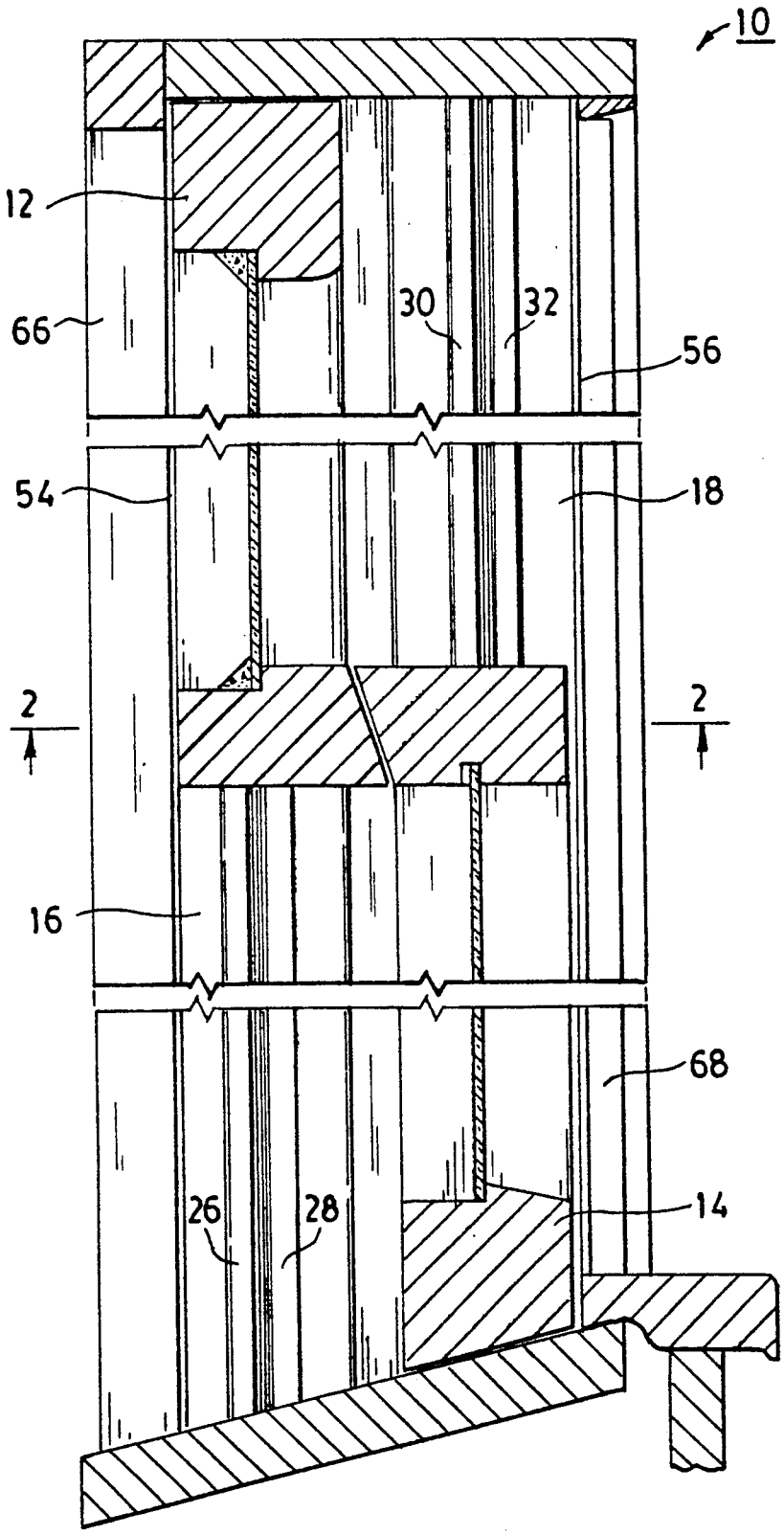
FIG. 1 is a cross-sectional view of a standard window assembly showing our new jamb liner in a front view.

One example of our jamb liner for mounting tilt-takeout sashes in a standard window assembly is shown in the drawing figures. The window assembly 10 includes upper sash 12 and lower sash 14 that are particularly designed for use in tilt-takeout window assemblies. The two sashes 12 and 14 are movable along respective upper and lower sash runs 16 and 18 that are formed in our jamb liner 20. Preferably, our jamb liner 20 is made as an extrusion of resin material that is cut to desired length.

Figure 2:
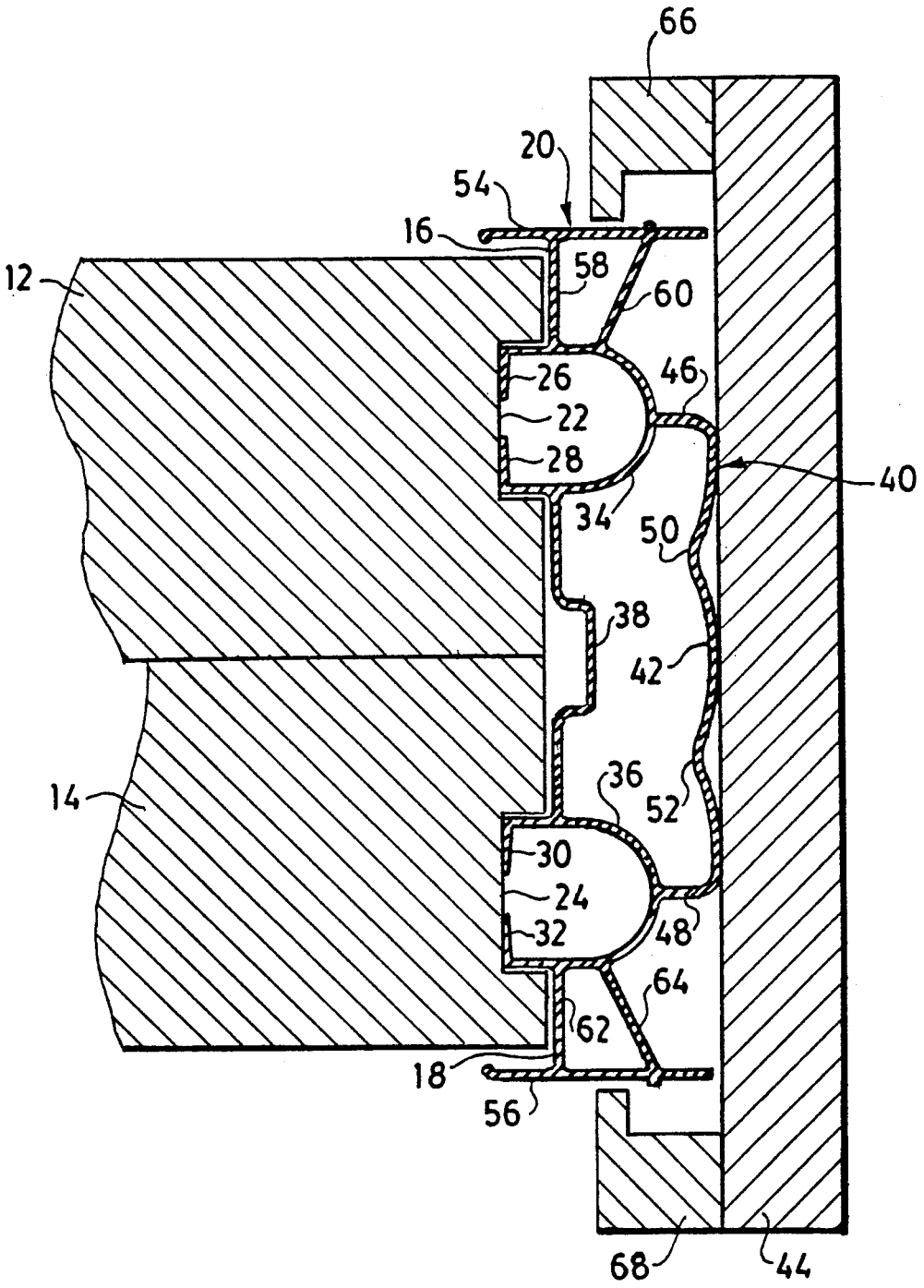
FIG. 2 is a cross-sectional view through the standard window and the liner along line 2—2 in FIG. 1.
Figure 3:
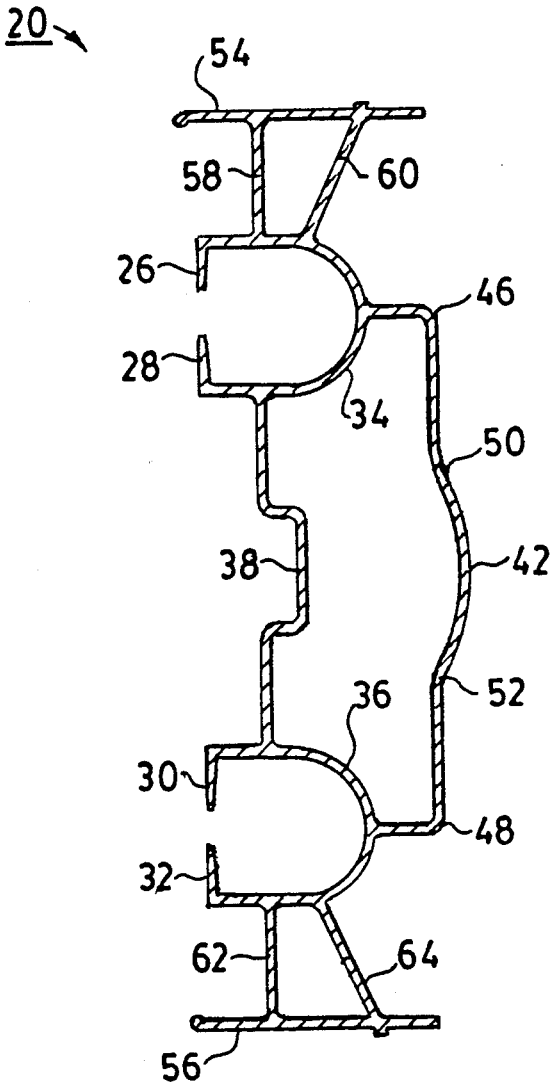
FIG. 3 is a cross-sectional view of our liner separate from the window assembly.

The upper and lower sashes 12 and 14, as shown in FIG. 2, are formed with respective shallow plows 22 and 24 that are engaged by respective pairs of tracks 26, 28 and 30, 32. The respective pairs of tracks are formed on ends of U-shaped channels 34 and 36 that provide housings for sash balances (not shown). The two channels 34 and 36 are interconnected by two webs 38 and 40. One web 38 of the two webs 38 and 40 forms adjacent portions of the sash runs 16 and 18. The other web 40 forms a bow-shaped spring 42 that urges the channels 34 and 36 apart from jamb 44 toward the respective sashes 12 and 14. The bow-shaped spring 42 exerts a substantially constant force on the sashes 12 and 14 throughout its length of compression against the jamb 44.

Brackets 46 and 48 are also formed by the other web 40 and join respective ends 50 and 52 of the spring 42 to the channels 34 and 36. The brackets 46 and 48 are shaped to function as respective stops for limiting compression of spring 42 and for establishing a minimum clearance between the channels 34 and 36 and the jamb 44.

The channels 34 and 36 are also connected to respective marginal flanges 54 and 56 by pairs of webs 58, 60 and 62, 64. One of the webs 58 and 62 of each pair forms a remaining portion of one of the sash runs 16 and 18. The other of the webs 60 and 64 of each pair provides reinforcement for holding the sashes 12 and 14 within the respective sash runs 16 and 18. The marginal flanges 54 and 56 are supported within the window assembly 10 by strips 66 and 68 that are attached to jamb 44.

The webs 58, 60, 62, and 64 joining the marginal flanges 54 and 56 to the channels 34 and 36 cooperate together with the webs 38 and 40 to provide our jamb liner with considerable torsional rigidity. Both channels 34 and 36 are urged into a tight sealing engagement with the respective sashes 12 and 14 by a single spring 42 that also seals our liner 20 to the jamb 44. Compression of the spring 42 by engagement of either channel 34 or 36 with one of the respective sashes 12 and 14 reduces any remaining travel of the spring 42 for urging the other channel away from the jamb 44. The brackets 48 and 50 are preferably right angled to further resist any warping of our liner when the spring 42 is fully compressed.

We claim:

1. A window jamb liner for mounting tilt-takeout window sashes between jambs to form a standard window assembly comprising:

an extruded body having a predetermined length extending between two ends and pairs of tracks extending along said length of the extruded body for engaging respective plows of upper and lower window sashes;

a pair of channels formed within said extruded body respectively joining the tracks of each of said pairs of tracks;

first and second webs formed within said extruded body separately joining said channels throughout said length of the extruded body;

said first web being formed within said extruded body by separate portions of respective window sash runs;

said second web being formed within said extruded body, in part, by a single spring for urging both of said channels apart from one of the said jambs; and said single spring having a first end joined to one of said channels, a second end joined to the other of said channels, and a bow-shaped portion interconnecting said first and second ends of the single spring to increase torsional stiffness between said channels.

2. The window jamb liner of claim 1 in which said second web is also formed within said extruded body in part by a pair of brackets that respectively join said first and second ends of the single spring to said channels.

3. The window jamb liner of claim 2 in which said brackets form a stop for limiting compression of said single spring against the one jamb and for separating said single spring from said channels to establish a minimum clearance between said channels and the one jamb.

4. The window jamb liner of claim 3 further comprising:

a pair of marginal flanges formed within said extruded body;

a first pair of additional webs formed within said extruded body for connecting one of said marginal flanges to said one of the channels; and a second pair of additional webs formed within said extruded body for connecting the other of said marginal flanges to said other of the channels.

5. The window jamb liner of claim 4 in which one of the webs of each of said first and second pairs of additional webs is formed by a remaining portion of the respective window sash runs, and the other of the webs of each of said first and second pairs of additional webs is spaced from said window sash runs to increase torsional stiffness between said marginal flanges and said channels.

6. A jamb liner for mounting window sashes between jambs in a window assembly comprising:

a pair of sash runs having a predetermined length extending between two ends;

a pair of channels respectively formed in said sash runs for engaging the window sashes;

a web separate from said sash runs interconnecting said channels in a fixed relationship throughout said length of the sash runs to increase torsional stiffness between said channels; and a single spring formed by a part of said web for urging both of said channels against the window sashes and having a first end joined to one of said channels, a second end joined to the other of said channels, and a bow-shaped portion interconnecting said first and second ends of the single spring throughout said length.

7. The jamb liner of claim 6 further comprising marginal flanges enclosing said pair of sash runs, each of said marginal flanges being joined to one of said channels by a portion of one of said sash runs and by one of two reinforcing webs that are spaced from said sash runs to increase torsional stiffness between said marginal flanges and said channels.

8. The jamb liner of claim 7 in which said channels are U-shaped having respective top portions for engaging plows of the window sash and respective bottom portions joined to said web.

9. The jamb liner of claim 8 in which a pair of brackets formed by remaining parts of said web join said first and second ends of said single spring to said respective bottom portions of said channels.

10. The jamb liner of claim 9 in which said brackets form a stop for limiting compression of said single spring against one of the jambs and for separating said single spring from said channels to establish a minimum clearance between said channels and the one jamb.

11. A jamb liner for mounting a pair of sashes between jambs of a window assembly comprising:

a pair of sash runs having a predetermined length extending between two ends;

a pair of channels formed in said sash runs for respectively engaging the sashes;

a web separate from said sash runs permanently interconnecting said channels throughout said length of the sash runs to increase torsional stiffness between said channels;

a single spring formed by a part of said web for urging both of said channels against the sashes and having first and second ends interconnected by a bow-shaped portion throughout said length;

a pair of brackets formed by two remaining parts of said web for joining said first and second ends of the single spring to said channels; and said pair of brackets forming a stop for limiting compression of said single spring against one of the jambs and for separating said single spring from said channels to establish a minimum clearance between said channels and the one jamb.

12. The jamb liner of claim 11 in which said channels are U-shaped having respective top portions for engaging plows of the sashes and respective bottom portions joined to said brackets.

13. The jamb liner of claim 12 further comprising marginal flanges respectively joined to said channels by pairs of additional webs.

14. The jamb liner of claim 13 in which one of the webs of each of said pairs of additional webs is formed by a portion of said sash runs and the other of the webs of each of said pairs of additional webs is spaced from said one web of each of the pairs of additional webs to increase torsional stiffness of said extruded body.

* * * * *